United States Patent [19]

Minsker

[11] 4,123,101

[45] Oct. 31, 1978

[54] FOLDING CHAIR

[76] Inventor: Lawrence D. Minsker, 102 Pleasant View Dr., Jamestown, N.Y. 14701

[21] Appl. No.: 744,655

[22] Filed: Nov. 24, 1976

Related U.S. Application Data

[63] Continuation of Ser. No. 568,408, Apr. 16, 1975, abandoned.

[51] Int. Cl.[2] ..... A47C 4/00

[52] U.S. Cl. ..... 297/58

[58] Field of Search ..... 297/58, 50, 51, 52, 297/63, 54, 55, 56, 77, 59, 60

[56] References Cited

U.S. PATENT DOCUMENTS

| | | | |
|---|---|---|---|
| 1,396,794 | 11/1921 | Travers | 297/50 |
| 1,919,746 | 7/1933 | Rastetter | 297/58 |
| 2,697,481 | 12/1954 | Zoercher | 297/60 |
| 3,025,100 | 3/1962 | Morgan | 297/58 X |

FOREIGN PATENT DOCUMENTS

| | | | |
|---|---|---|---|
| 800,886 | 11/1950 | Fed. Rep. of Germany | 297/58 |
| 801,220 | 11/1950 | Fed. Rep. of Germany | 297/58 |
| 2,561 of | 1893 | United Kingdom | 297/58 |

*Primary Examiner*—Roy D. Frazier
*Assistant Examiner*—Peter A. Aschenbrenner
*Attorney, Agent, or Firm*—Charles L. Lovercheck

[57] ABSTRACT

A folding chair having integral front legs and backrest is disclosed herein. A seat is attached to each leg by a bracket. Each bracket is made up of two parts angular in cross section, each having one flange pivoted to the flange of the other. One flange underlies the seat and is pivoted and slidably connected by means of a pin in a slot to each rear leg. The brackets are so made that the legs fold within each other and the seat folds between the legs so that the folded chair has a thickness which is only as thick as the width of the legs thereby providing a compact package.

1 Claim, 7 Drawing Figures

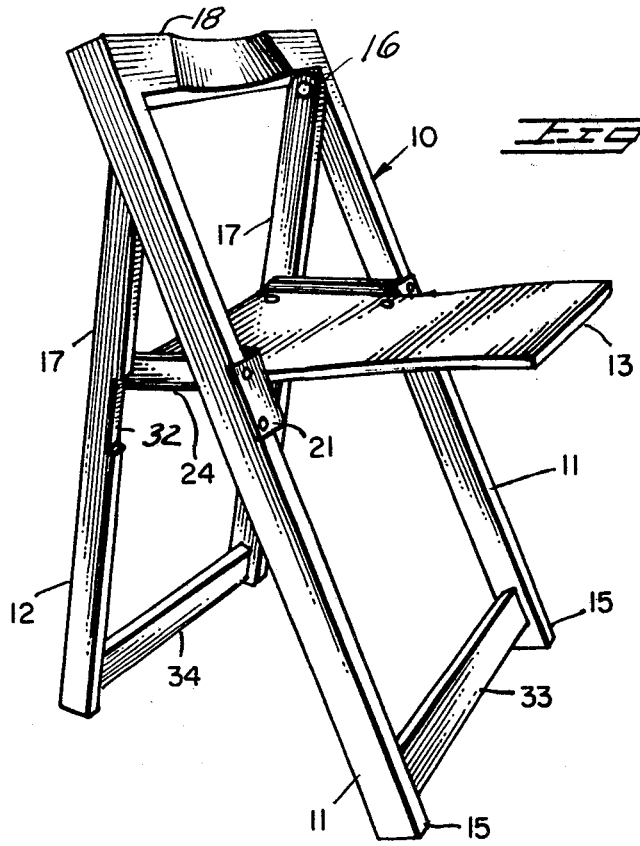
Fig 1.
Fig 2.
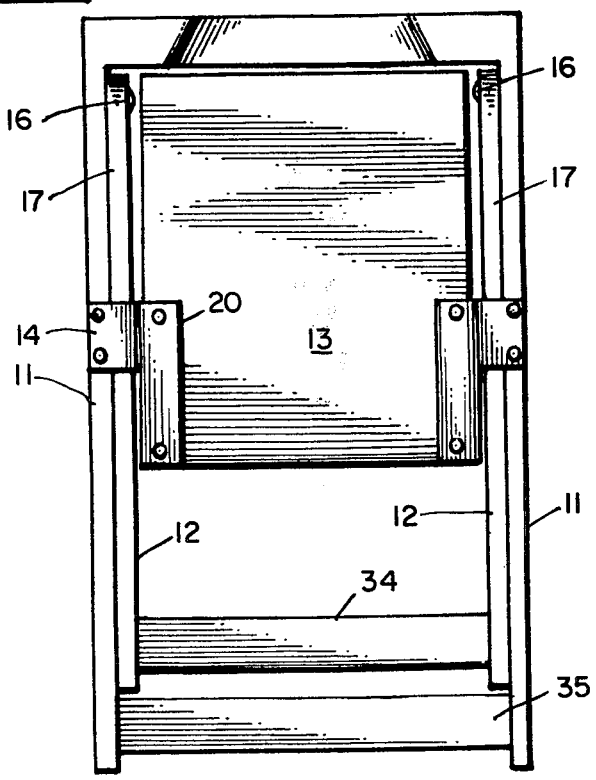
Fig 3.
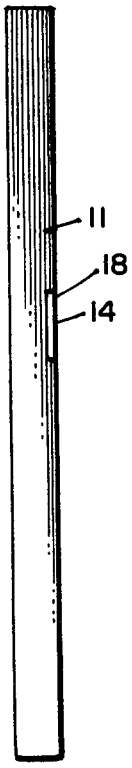

FIG. 5
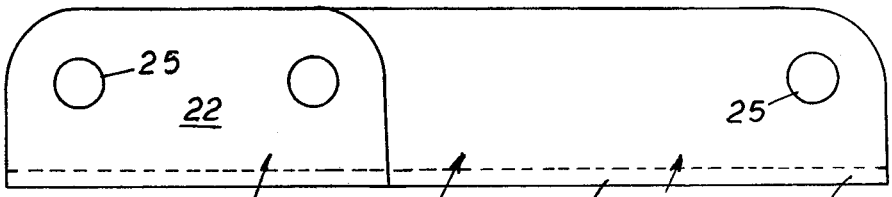
FIG. 4
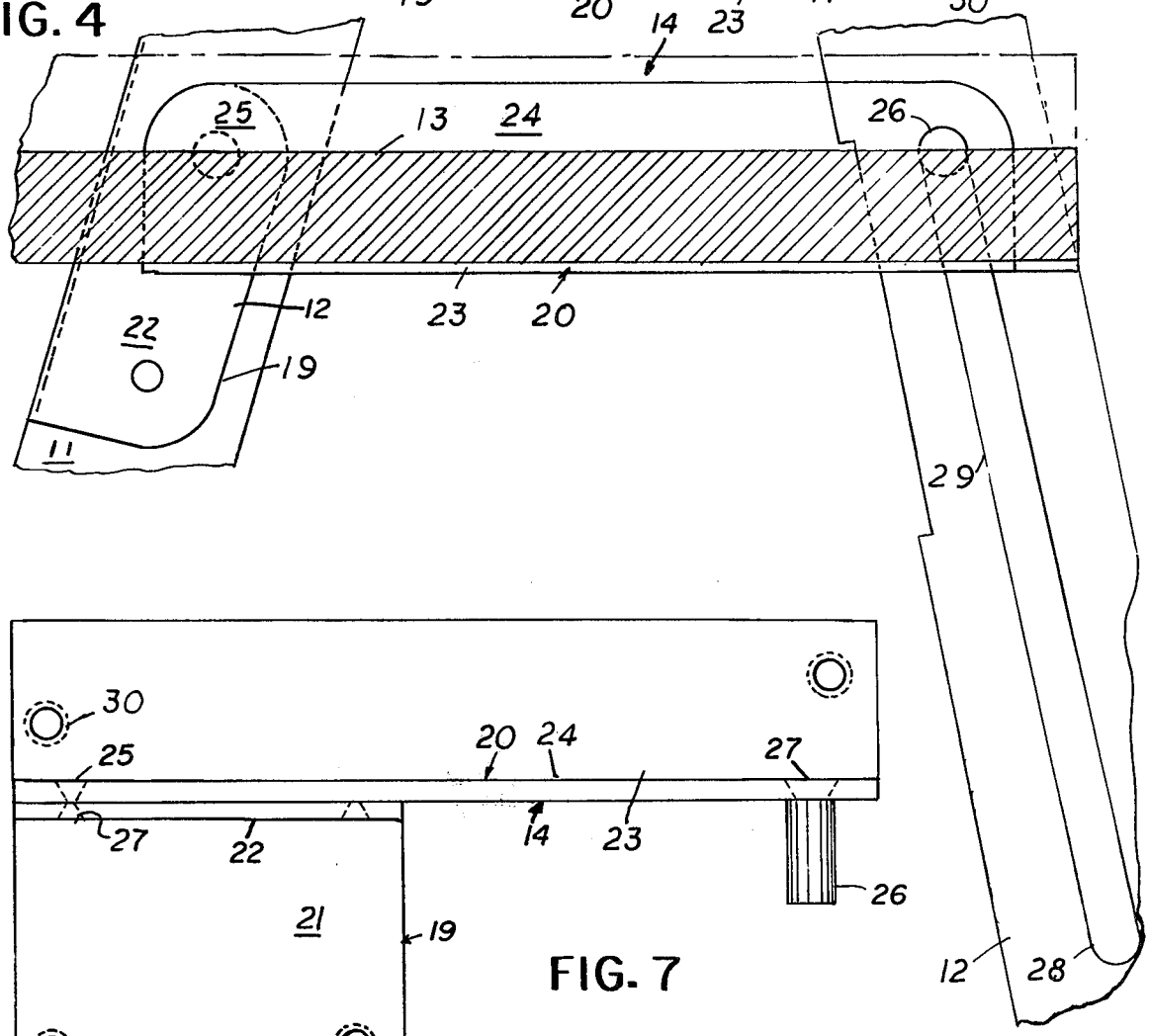
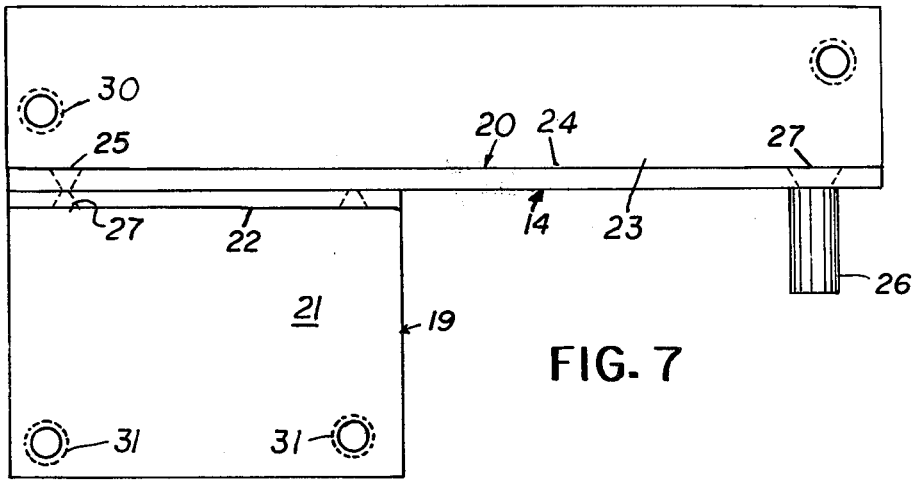
FIG. 7
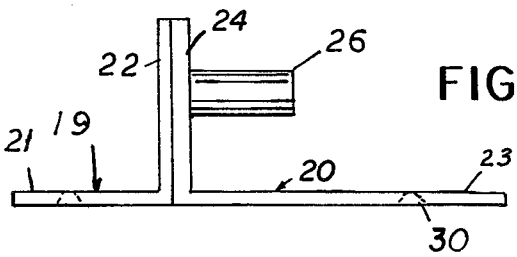
FIG. 6

FOLDING CHAIR

This is a continuation of application Ser. No. 568,408 filed Apr. 16, 1975, now abandoned.

REFERENCE TO PRIOR ART

A folding chair of the general type disclosed herein made of metal is disclosed in my U.S. Pat. No. 3,815,952.

OBJECTS OF THE INVENTION

It is an object of the invention to provide an improved folding chair.

Another object of the invention is to provide a folding chair that will be readily and efficiently folded into a compact package. Four folding chairs will fit into the well of a folding table, which then becomes their storage unit.

Another object of the invention is to provide a folding chair in combination with an improved bracket.

With the above and other objects in view, the present invention consist of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

FIG. 1 is an isometric view of the chair according to the invention.

FIG. 2 is a front view of the chair in folded relation.

FIG. 3 is a side view of the chair folded.

FIG. 4 is a partial cross sectional view of the chair.

FIG. 5 is a side view of one of the brackets removed from the chair.

FIG. 6 is a front view of the bracket.

FIG. 7 is a top view of the bracket.

DETAILED DESCRIPTION OF THE DRAWINGS

Now with more particular reference to the drawings, the chair is generally indicated at 10. It has front legs 11, rear legs 12, a seat 13 and a bracket 14 that holds the seat to the legs. The upper ends of the front legs 11 are fixed to the backrest 18 and the upper ends of the front legs 11 are pivoted to the upper ends 17 of the rear legs 12 by pivots 16. The seat 13 is supported at each side on one of the horizontal flanges 23 of the angle member 20. The vertical leg 24 of angle member 20 lies in a plane parallel to the plane of the flange 22 of angle 19 and the two flanges 22 and 24 are pivoted together by a pivot 25. The rear of flange 24 has a pin 26 pinned into it at 27 and pin 26 slides in slot 29 which is formed in the rear leg 12 and extends generally parallel to the longitudinal dimension of each rear leg. Thus, when the chair is folded, the pins 26 slide from the upper end of the slots 29 from the position shown in FIG. 4 to the lower end 28 of the slot. In this position, the bracket has moved so that the two angle members of the bracket are in alignment with each other in the position shown in FIG. 5 and the rear legs are folded inside the front legs to the position shown in FIG. 3. Seat 13 is held to bracket 14 by screws in flange 24.

Holes 30 formed in the leg 23 of the angle 20 receive screws which are inserted into the seat member 13. Seat 13 is carried by angle 20 which is supported at its front end by pivot 25 and at its rear end by pin 26.

The legs 21 of the angle 20 rest in a slot on the front side of the front chair legs 11 and are held to the chair legs 11 by screws in the holes 31. When the chair is folded, the legs 21 of the bracket 14 can move into the recesses 32 in the rear legs.

The legs 11 are held together in spaced relation by the backrest 18 and the lower cross bar 33. The rear legs are held in spaced relation by the pivots 16 and by the cross bars 34.

The bracket 14 at the right side of the chair is identical to the bracket 14 at the left side except that the angle 19 and the angle 20 are turned end for end and pin 25 is interchanged with pin 26.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A wooden folding chair comprising front legs disposed in rigid spaced relation with each other and extending upwardly and rearwardly to form supports for a back member, and rear legs pivotally connected within the upper portions of said front legs disposed in rigid spaced relation with each other, a seat pivotally disposed within said front and rear legs and a first bracket and a second bracket disposed on each side of said seat, said brackets each comprising a seat angle member and a front leg angle member, said seat angle members and said front leg angle members each having a first flange disposed in a vertical plane and a second flange fixed to the first flange and generally perpendicular thereto, said first flanges of said seat angle member and said front leg angle member being disposed in planes adjacent and parallel to each other, pivot means connecting said first flange of each of said angle members together at the front portion of the seat angle members, said first flanges of said seat angle members resting on said seat edges, said second flanges of said front leg angle member fixed to the front edges of said front legs, said seat flanges of said second angle members underlying said seat and being fixed thereto, said rear legs each having a downwardly extending inwardly facing slot and a laterally extending pin means on the rear portions said first flanges of said seat angle members slidably receivable in said slots in said rear legs.

* * * * *